US008893635B2

(12) United States Patent
McCary

(10) Patent No.: US 8,893,635 B2
(45) Date of Patent: Nov. 25, 2014

(54) CANTED SAIL RIG

(71) Applicant: John Milner McCary, Birmingham, AL (US)

(72) Inventor: John Milner McCary, Birmingham, AL (US)

( * ) Notice: Subject to any disclaimer, the term of this patent is extended or adjusted under 35 U.S.C. 154(b) by 0 days.

(21) Appl. No.: 13/815,243

(22) Filed: Feb. 13, 2013

(65) Prior Publication Data

US 2014/0224160 A1 Aug. 14, 2014

(51) Int. Cl.
*B63H 9/04* (2006.01)
*B63B 15/00* (2006.01)

(52) U.S. Cl.
CPC ..... *B63B 15/0083* (2013.01)
USPC ..... 114/93

(58) Field of Classification Search
USPC ..... 114/91, 93
See application file for complete search history.

(56) References Cited

U.S. PATENT DOCUMENTS 4,584,957 A * 4/1986 Belvedere ..... 114/39.28
4,653,417 A * 3/1987 White ..... 114/91
4,917,036 A * 4/1990 Berg ..... 114/91
5,918,561 A * 7/1999 Berean ..... 114/102.16

FOREIGN PATENT DOCUMENTS

FR 2579557 A1 * 10/1986 ..... B63B 15/02

* cited by examiner

*Primary Examiner* — Edwin Swinehart

(57) ABSTRACT

The present invention entails a canting sailboat sail rig. Mast support struts are attached at one end to the outer edges or railings of the hull(s), to the stern of the mast, and the mast struts attach at the other end to the lower sections of the mast. The mast foot base is attached to a circular track that runs from the centerline of the sailboat outward, toward the edges of the hulls, and upward the bow(s). When the mast foot move outward and upward toward the railing and bow(s) the upper section of the sail tilts or cants in the opposite direction from the mast foot outward direction, creating forward thrust, lift and reduced heeling. A jib can be attached to the head of the mast and the combination canting mainsail and jib can create force, lift and less heeling.

2 Claims, 3 Drawing Sheets

CANTED SAIL RIG

BACKGROUD OF THE INVENTION

Sailboats are propelled by wind flowing around the sail to create thrust. The wind produced thrust forces generate lateral pressures that are resisted by an opposing force where pressure or force is applied by water to the below water line of the sailboat. These forces create a tilting effect on the sailboat commonly called heeling. A sailboat's speed can be significantly reduced or limited by this heeling. One way to compensate for heeling of the sailboat is to increase the below water lateral resisting force area or keel and add weight to the keel area. Increasing the keel weight and expanding the below water surface increases drag, further possibly reducing boat speed. The degree of the total drag force is in relation to the composition of the hull surface (how slick), hull shape, the shape and rigging configuration of the sail(s) plus other factors. Heeling effect can also be reduced by shifting the weight on the sailboat to the windward side of the sail. With increasing wind speeds the tendency to heel may be difficult to compensate for and ultimately significant limits boat speed. If a sailing rig could create lift or upward force as well as thrust the hull(s) could have forces pulling it out of the water, with an associated reduction in heeling. The pulling up forces on the hull(s) can considerably reduce hull drag and increasing the speed of the sailboat.

Prior systems for achieving lift have caused some lee helm caused by the center of pressure in the sail being windward of the centerline of the sailboat. Lee helm or tendency for the boat to turn into the wind results in excessive use of rudder usage which increases drag. The sail needed to be tilted athartships, or to the stern, to a certain point depending on wind speed and point of sail to help alleviate lee helm.

Some of the tilted or canted systems attached the mast to a flexible joint sitting on the centerline or to a straight or curved track running toward the stern of the sailboat. Maximum lift and minimum drag is usually is not reached due to the lack of these systems to be able to position the sail in the needed position with the desired adjustments and to optimize angles with respect to the wind. Also there is not an existing system to allow the jib sail to work efficiently with the mainsail and be adjusted with the mainsail to produce the desired lift.

What is needed is a tilting or canted lift producing sail system that allows the mast foot to easily be adjusted and/or moved such that the mast tilts in multiple axes to maximize lift and reduce drag. The sail system can be implemented with or without a jib, or headsail. The sail controls need to be straight forward, not too many control lines and not overly complicated. The canting sailboat sail rig should be able to use conventional sail production methods to control cost and to simplify the sail rig.

SUMMARY OF THE INVENTION

The present invention relates to an improved lift creating sail system. The mast foot base is connected to a circular track that runs from the centerline of the hull(s) and runs outward and curving toward the bow of the sailboat. Mast supports or struts are attached to the Hull deck near the outward point on the hull(s) deck and located to the stern of the circular mast foot track. The other end of the two mast struts are attached to the mast at point approximately ¼th to $\frac{1}{6}^{th}$ up the mast from the sailboat deck. The mast support struts help support the mast and allow the mast foot base to be able to move along the mast foot base track. As the mast foot moves outward along the mast circular track the mast struts, where the mast struts are connected to the mast, rotate downward and the upper section of the mast tilts in the direction opposite that the mast foot moves along the circular track and the top of the mast usually also tilts toward the stern of the sailboat. The mast strut's length and attachment location to the deck and mast may be adjusted, along with other rigging, to the wind direction and speed. The canted sails create forward thrust, hull lift and reducing heeling. A wishbone style rigged sail may get the best results from using this canting mast rig but other sail type rigs can be used.

A jib, or headsail, can be added as part of the canted sail rig system but the shape of the mast base track may have to be altered depending on the style and size of the sailboat. A jib can be attached near the top of the mast and to the bow, between the bows of two hulled type catamaran or on the center hull of a trimaran. The other corner, or clew, can be self tacking or cleated, jib sheets attached, on the outward side of the hull(s). The circular mast base track is shaped such to allow the mast foot to move outward along the mast base track and the upper section of the mainsail to tilt toward the opposite side of the sailboat. The distance from where the jib attaches to the bow and the point where the jib attaches on the mast stays fairly constant, keeping the jib leech fairly tight. Both the mainsail and the jib simultaneously tilt or cant and both create forward thrust and lift and heeling is reduced.

A mast supporting spreader may be used to support the mast, either with or without a jib attached to the mast. The lower mast attaching point of the spreader is attached some distance below the point where the mast support struts attach by placing the lower point of the spreader mast attachment at the particular mast point. This mast spreader attachment configuration gives added lateral and bending support to the mast.

DETAILED DESCRIPTION OF THE INVENTION

Figure 1:
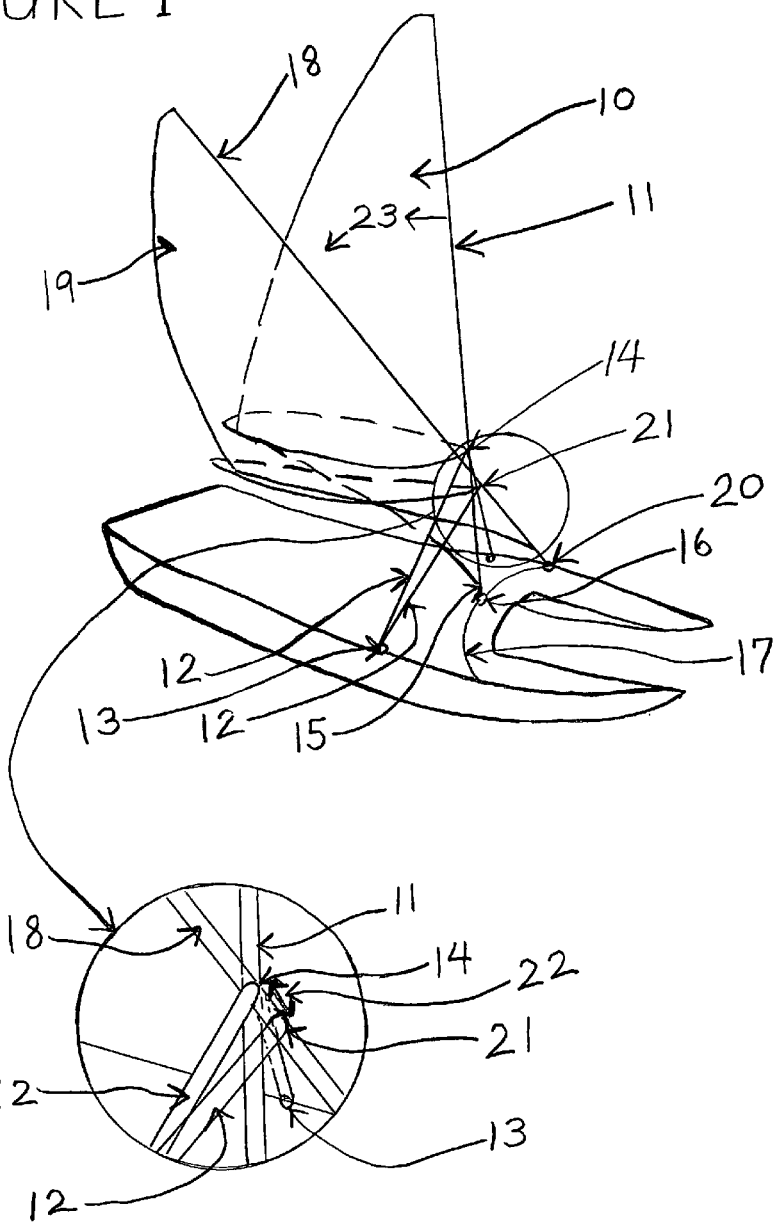
FIG. 1 shows in a side perspective view is the canted sailboat sail rig assembly with one sail showing the sail in vertical position and also the sail in tilted or canted position.

FIG. 1, shows in a side perspective view the canted sailboat sail rig with one sail. The one mainsail 10 is shown with the mast 11 in the non-tilted position. Mast support struts 12 are attached at one end to the hull(s) toward the deck railings 13 and at the other end to the lower section of the mast 14. The mast foot base 15 is attached to a moving car 16 on the mast base circular track 17. The tilting or canted mast 18 with sail 19 is created by the outward and toward the bow movement of the mast foot base 20, in the opposite direction on the mast base circular track 17. The point where the mast support struts 12 attach to the mast 21 rotates downward 22. The tilted sail 19 also rotates toward the stern 23.

Figure 2:
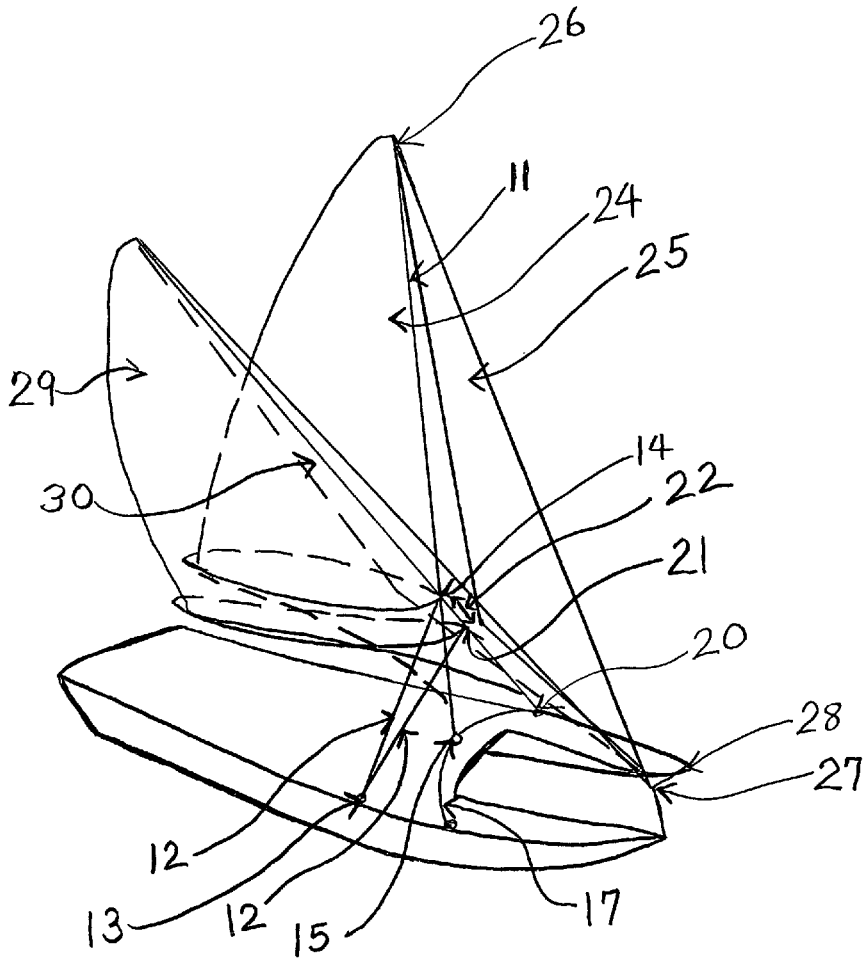
FIG. 2 is a side perspective view of the canted sailboat sail rig assembly with a mainsail and a jib in mainsail mast in vertical position, and mainsail and jib in tilted position.

Shown in FIG. 2 in a side perspective view the canted sailboat sail rig with mainsail and jib, or headsail. The mainsail 24 and jib 25 are shown in the non-tilted or non-canted position, with the mast support struts 12 attached near the hull(s) railings 13 and to the lower section of the mast 14. The jib's head 26 is attached near the top of the mast 11 and the jib tack 27, near the bow(s) 28. When the mast foot base 15 travels towards the railings of the hull(s) 13 on the mast foot base circular track 17 the upper sections of the mainsail 29 and the jib 30 tilt or cant outward in the opposing direction from the outward movement of the mast foot base 20. The point where the mast struts attach to the mast 21 rotates downward 22.

Figure 3:
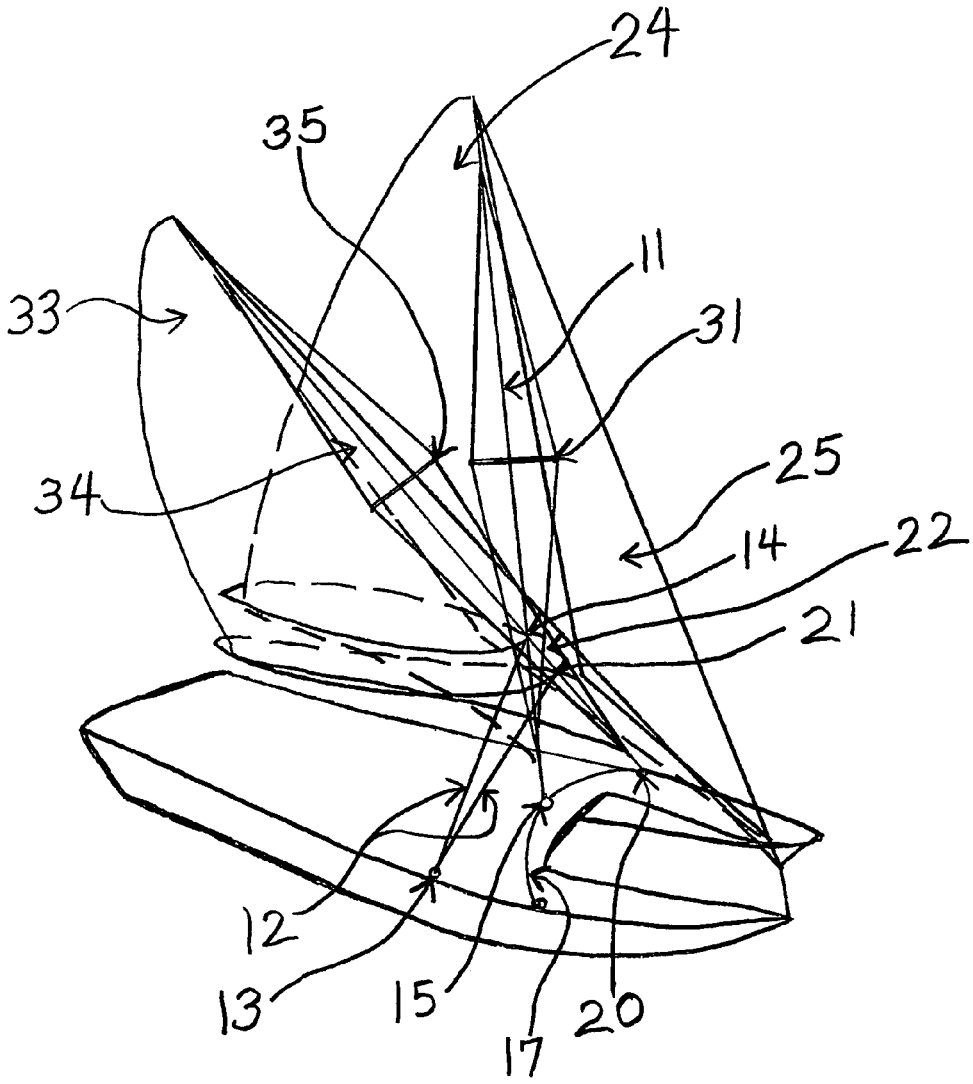
FIG. 3 shows in a side perspective view the canted sailboat sail rig assembly with a mainsail and jib and a mast spreader.

FIG. 3. also shows in a side perspective view the non-canted mainsail 24 and jib 25 with the jib's head 26 is attached to the top of the mast 11 and the jib tack 27 attached near the bow(s) 28. The mast strut 12 is shown attached near the hull(s) railings 13 and the other end of mast strut to the lower section of the mast 14. The mast foot base 15 is attached to the mast base circular track 17. The mast spreader 31 is attached to the mast 11 with the lower attaching point of the spreader 32 attached to the mast below the point where the mast struts attach to the mast 14 giving bending support to the mast 11. The tilted mainsail 33 and tilted jib 34 and the attached mast spreader 35 is shown. When the mast foot base 15 travels toward the railing of the hull(s) 13 the upper sections of the mainsail 33 and the jib 34 tilt or cant outward in the opposing direction from the outward movement of the mast foot base 20. The point where the mast struts attach to the lower section of the mast 21 also rotates downward 22.

The invention claimed is:

1. A canting lift creating sailboat sail rig assembly, comprising:

a. a mast base circular track, said mast base circular track located approximately ⅔rds a distance from a stern of a sailing vessel or sailboat, said stern of a sailboat being the most rearward end of the sailboat, to a bow(s) of a sailboat, said bow(s) being the most forward end of a sailboat, and said mast base circular track runs from the stern to bow(s) center line of said sailboat outward and toward an outward edge(s) of a sailboat hull(s), where said outward edges of said sailboat hull(s) means toward the outer most edge of the outward most hull(s), where said hull(s) being the sailboat's flotation means and where said sailboat may have one, two or more said hulls, with an outward ends of the mast base circular track, said outward ends of the mast base circular track being the most outward ends of the circular track curving toward the bow(s) of the sailboat; and b. a mast, where said mast is a vertical structure extending upward from the sailboat's deck, said sailboat deck is a horizontal upper surface on or near the sailboat hull(s), and a lower end of the mast, or mast base, where said mast base is an attaching mechanism at the lower end of said mast that is coupled to the mast base circular track; and c. a mast rigid supports or struts, said mast struts are rigid supporting members, a lower end of the mast struts, where said lower end of the mast struts have attaching mechanisms which are attached to or near the outward edges of the sailboat hull(s) and attached sternward from the most sternward location of the mast base circular track; and d. an upper end(s) of the mast struts, where said upper ends of the mast struts have attaching mechanisms which are attached at an attaching point to the mast, where said upper ends of the mast struts attaching mechanism attaching point is at about $\frac{1}{4}^{th}$ to $\frac{1}{6}^{th}$ the length of the mast distance up the mast from a sailboat hull(s) deck; and e. the mast struts help hold the mast up vertically and support the mast weight, lateral, downward and upward pressure put on the mast; and f. the supporting mast struts allow the mast to move along the mast base circular track; and g. as the mast base is moved while sailing or the sailboat being stationary, outward from the stern to bow centerline of the sailboat coupled to and moving along the mast base circular track, the mast struts rotate downward toward the bow and an upper section of the mast, where said upper section of the mast is the section of the mast that is above the attaching point of the mast struts attachment to the mast, where said upper section of the mast tilts or cants aft ward and outward in the opposite direction the mast base moves along the mast base circular track; and a mainsail, were said mainsail is usually a sail attached on a mainsail's vertical edge to the mast, with or without a horizontal supporting member, a mainsail boom or a boom, where said boom or mainsail boom, being in or near a horizontal to the deck of the sailing vessel, may be attached to the mast; and j. a mainsheet, where said mainsheet is a line that is attached to the mainsail or the mainsail boom; and k. a pulling in or letting out, or trimming of the mainsheet, where said trimming of the mainsheet controls an angle of a longitudinal plane of the mainsail, where the longitudinal axis plane angle of the mainsail is relative to a stern to bow centerline vertical plane of the sailboat; and l. the combination of the mast, with attached mainsail, simultaneously tilting or canting aft ward and outward along the mast base circular track and the pulling in and letting out, or trimming the mainsail sheet, controls the forward thrust and lifting forces of the wind on the mainsail, and the degree of heeling of the sailboat.

2. A canting lift creating sailboat sail rig assembly according to claim 1, where:

a. a jib sail, where said jib sail is a sail attached forward from the location of the mainsail, where the jib sail has a top end corner, where said top end corner of said jib sail is attached near the upper section of the mast; and b. a forward bottom corner or tack, of the jib, where said tack of the jib is attached near the bow(s) of the sailboat; and c. a toward the stern bottom corner, or clew, of the jib, where said clew of the jib is attached to lines or jib sheets, where said jib sheet(s) is attached to either the outward edges of the sailboat deck(s) or the jib is self tacking or trimmed by and attached to a self tacking mechanism; and d. as the mainsail mast base is moved outward, while sailing or stationary, from the stern to bow centerline of the sailboat toward the outward edges of the hull(s) and coupled to and moving along the mast base circular track, the upper sections of the mast with attached mainsail and jib, simultaneously tilts or cants aft ward and outward in the opposite direction of the movement direction of the mast base coupled to the mast base circular track, with the pulling in and letting out, or trimming the mainsail sheet and jib sheets, controls the forward thrust and lifting forces of the wind on the mainsail and iib, and the degree of heeling of the sailboat.

* * * * *